US008083983B2

(12) United States Patent
Rabolt et al.

(10) Patent No.: US 8,083,983 B2
(45) Date of Patent: Dec. 27, 2011

(54) METHOD OF SOLUTION PREPARATION OF POLYOLEFIN CLASS POLYMERS FOR ELECTROSPINNING PROCESSING INCLUDED

(76) Inventors: John F. Rabolt, Wilmington, DE (US); Keun-Hyung Lee, Newark, DE (US); Steven R. Givens, Smyrna, DE (US)

( * ) Notice: Subject to any disclaimer, the term of this patent is extended or adjusted under 35 U.S.C. 154(b) by 970 days.

(21) Appl. No.: 11/562,797

(22) Filed: Nov. 22, 2006

(65) Prior Publication Data

US 2010/0056007 A1 Mar. 4, 2010

Related U.S. Application Data

(60) Provisional application No. 60/740,222, filed on Nov. 28, 2005.

(51) Int. Cl.
*B29C 47/00* (2006.01)
*H05B 6/00* (2006.01)
*H05B 7/00* (2006.01)

(52) U.S. Cl. ..... 264/465; 264/464; 264/484

(58) Field of Classification Search ..... 442/401; 264/465, 413, 205, 464, 484; 526/348; 428/98, 428/292.1, 304.4, 368, 365, 370; 210/3, 210/505
See application file for complete search history.

(56) References Cited

U.S. PATENT DOCUMENTS

| | | | | |
|---|---|---|---|---|
| 2,957,225 | A * | 10/1960 | Welch et al. | 526/348.2 |
| 3,032,384 | A * | 5/1962 | Riley et al. | 264/205 |
| 4,323,525 | A | 4/1982 | Bornat | |
| 4,689,525 | A | 8/1987 | Shimoma et al. | |
| 5,456,982 | A * | 10/1995 | Hansen et al. | 428/370 |
| 7,575,707 | B2 * | 8/2009 | Xia et al. | 264/465 |
| 2001/0045547 | A1 | 11/2001 | Senecal et al. | |
| 2002/0046656 | A1 | 4/2002 | Benson et al. | |
| 2002/0084178 | A1 | 7/2002 | Dubson et al. | |
| 2002/0100725 | A1 * | 8/2002 | Lee et al. | 210/503 |
| 2002/0175449 | A1 | 11/2002 | Chu et al. | |
| 2003/0021792 | A1 | 1/2003 | Roben et al. | |
| 2003/0106294 | A1 | 6/2003 | Chung et al. | |
| 2003/0137069 | A1 | 7/2003 | Reneker | |
| 2003/0168756 | A1 | 9/2003 | Balkus et al. | |
| 2003/0195611 | A1 | 10/2003 | Greenhalgh et al. | |
| 2003/0215624 | A1 | 11/2003 | Layman et al. | |
| 2004/0013873 | A1 | 1/2004 | Wendorff et al. | |
| 2004/0018226 | A1 * | 1/2004 | Wnek et al. | 424/443 |
| 2004/0037813 | A1 | 2/2004 | Simpson et al. | |

(Continued)

FOREIGN PATENT DOCUMENTS

| | | |
|---|---|---|
| WO | WO 2005/057700 | 6/2005 |
| WO | WO 2005090654 A1 * | 9/2005 |

OTHER PUBLICATIONS

Reneker, et al., Nanometre Diameter Fibres of Polymer, Produced by Electrospinning, article, 1996, pp. 216-223, 7, *Nanotechnology*, UK.

(Continued)

*Primary Examiner* — Elizabeth Cole
*Assistant Examiner* — Altrev Sykes
(74) *Attorney, Agent, or Firm* — RatnerPrestia

(57) ABSTRACT

A process to make a polyolefin fiber which has the following steps: mixing at least one polyolefin into a solution at room temperature or a slightly elevated temperature to form a polymer solution and electrospinning at room temperature said polymer solution to form a fiber.

7 Claims, 5 Drawing Sheets

U.S. PATENT DOCUMENTS

| | | | | |
|---|---|---|---|---|
| 2004/0038014 | A1 | 2/2004 | Schaefer et al. | |
| 2004/0060268 | A1 | 4/2004 | Chung et al. | |
| 2004/0060269 | A1 | 4/2004 | Chung et al. | |
| 2004/0123572 | A1 | 7/2004 | Chung et al. | |
| 2004/0187454 | A1 | 9/2004 | Chung et al. | |
| 2005/0051481 | A1 * | 3/2005 | Husain et al. | 210/615 |
| 2005/0129922 | A1 | 6/2005 | Mrozinski et al. | |
| 2005/0163955 | A1 | 7/2005 | Schaefer et al. | |
| 2006/0160064 | A1 * | 7/2006 | Carbonell | 435/4 |
| 2007/0113358 | A1 * | 5/2007 | Rabolt et al. | 8/500 |

OTHER PUBLICATIONS

Megelski, et al., Micro- and Nanostructured Surface Morphology on Electrospun Polymer Fibers, article, 2002, pp. 8458-8466, *Macromolecules*, US.

Casper, et al., Controlling Surface Morphology of Electrospun Polystyrene Fibers: Effect of Humidity and Molecular Weight in the Electrospinning Process, article, 2004, pp. 573-578, 37, *Macromolecules*, US.

Lee, et al., Electrostatic Polymer Processing of Isotactic Poly(4-methyl-l-pentene) Fibrous Membrane, article, 2006, pp. 8013-8018, 47, *ScienceDirect*, US.

Stephens, et al., From the Spider to the Web: Biomimetic Processing of Protein Polymers and Collagen, article, 2003, pp. 02.3.1-02.3.10, 774, *Materials Research Society*, US.

Lux, Rudolf; Extended European Search Report; May 8, 2009; 5 pp; European Patent Office, Munich, Germany.

Zheng-Ming Huang et al., "A Review on Polymer Nanofibers by Electrospinning and Their Applications i Nanocomposites," *Composites Science and Technology*, No. 63, Apr. 2003, pp. 2223-2253.

* cited by examiner

METHOD OF SOLUTION PREPARATION OF POLYOLEFIN CLASS POLYMERS FOR ELECTROSPINNING PROCESSING INCLUDED

RELATED APPLICATIONS

This application claims benefit to US provisional application 60/740,222 filed Nov. 28, 2005 which is incorporated by reference in its entirety for all useful purposes.

GOVERNMENT LICENSE RIGHTS

The United States Government has rights in this invention as provided for by NASA Genetically Engineering Polymer Contract or grant no(s): MASC 372116 and NSF EPSCoR Grant No. EPS-0447610.

BACKGROUND OF THE INVENTION

The investigation of structure/property relationships in materials often requires processing prior to the measurement of their properties. Fiber spinning is often the processing method of choice in long chain polymers because of the subsequent chain alignment that occurs during the shear and windup process. This alignment can give rise to highly anisotropic electrical, mechanical and photonic properties. Unfortunately commercial spinning lines need large (5-10 lbs) quantities of starting material in order to produce melt-spun fibers. This limits the candidates for investigation to those that are made in sufficiently large quantities and/or those that do not degrade at elevated temperatures, in the case of melt spinning. Solution spinning is possible as an alternative method but has been reserved for those polymers that dissolve in volatile and often times aggressive solvents (e.g., KEVLAR® in sulfuric acid). (KEVLAR® is a polyamide, in which all the amide groups are separated by para-phenylene groups, that is, the amide groups attach to the phenyl rings opposite to each other, at carbons 1 and 4 and is manufactured by DuPont), in sulfuric acid).

The electrospinning of fibers has been investigated for more than 30 years. However, since 1998 the number of publications on electrospun polymer nanofibers have grown exponentially, Z. M. Huang, Y. Z. Zhang, M. K. Kotaki and S. Ramakrishna, Composites Sci. and Tech. 2003, 63, 2223-2253 ("Huang"), US20030137069. Electrospinning, an offshoot of electrospraying, can be used to spin spider-web type fibers (see FIGS. 1-3) for characterization and testing of their mechanical and surface properties. The fibers produced during the electrospinning process are microscale and nanoscale, with diameters ranging (D. H. Reneker and I. Chun, *Nanotechnology* 1996, 7, 216 ("Reneker")) from 40 nm to 5 μm compared to traditional textile fibers which have diameters (Reneker) of 5 to 200-μm. The primary advantage of electrospinning is that it uses minute quantities (as little as 10-15 mg) of polymer in solution to form continuous fibers. Although a number of commodity polymers have already been electrospun (Huang and S. Megelski, J. S. Stephens, D. B. Chase and J. F. Rabolt, *Macromolecules* 2002, 35, 8456 ("Megelski"), an understanding of the mechanism and parameters that affect the electrospinning process is only starting to emerge. There are a limited number of parameters that appear to effect the fiber diameter, the concentration of "beads", the fiber surface morphology and the interconnectivity of polymer fibrils. These include solution concentration, distance between "nozzle" and target molecular weight of the polymer, spinning voltage, humidity, solvent volatility and solution supply rate. Although some of these (e.g., molecular weight, humidity) have been investigated in detail (C. Casper, J. Stephens, N. Tassi, D. B. Chase and J. Rabolt, *Macromolecules* 2004, 37, 573-578 ("Casper") and Megelski most of the work has focused on investigation of the development of microstructure in fibers and their potential applications ranging from tissue engineering constructs to fuel cell membranes.

Electrospinning is a simple method that can prepare fibers with submicron diameter using electrostatic force. Submicron fibers prepared by this technique have recently come under intense scientific study due to wide ranging potential applications including filtration, optical fibers, protective textiles, drug delivery system, tissue engineering scaffolds, and gas separation membranes etc.

Many polymers, synthetic and natural, have been successfully spun into nano-, and/or micron-sized fibers from polymer solution and melt. Although polyolefin $(CH_2—CH_2)_n$, poly-α-olefin $(CH_2—(R—CH))_n$, with R=aliphatic, aromatic or cyclic groups, their copolymers and/or their polymer blends are important commercial polymers, very limited work on the electrospinning of polyolefins, poly-α-olefins, their copolymers and/or their polymer blend fibers exists. In the case of polyolefins, poly-α-olefins, their copolymers and/or their polymer blends have limited solubility due to their excellent chemical resistance and non-polar structure, and hence are not easy to electrospin from solution. All investigations thus far have used melt-electrospinning.

BRIEF DESCRIPTION OF THE INVENTION

The invention relates to a process for producing a porous membrane with polyolefin classes of polymers using the electrospinning process. These polyolefin membranes and/or membranes made from poly-α-olefin, their copolymers and/or their polymer blends have a high surface area, small pore size, soft feel, flexibility and possess the possibility of producing 3-dimensional structures for use in filtration, protective textiles and gas separation etc.

Polyolefins and poly-α-olefins like polyethylene, polypropylene, poly-1-butene (PB), poly-1-pentene, poly-1-hexene, poly(3-methyl-1-butene), poly(4-methyl-1-pentene) (PMP), poly(4-methyl-1-hexene), poly(5-methyl-1-heptene), etc and their copolymers and polymer blends consist of hydrocarbon chains of varying lengths, etc, and are in general and/or special use in many industrial applications.

According to this invention, polyolefin, poly-α-olefin, their copolymers and/or their polymer blends are completely dissolved in a multi-component solvent system to form a clear or transparent solution indicating that gelation has hot occurred when heating from room temperature to a higher temperature depending on the polymer type, molecular weight and solvent system used. Room temperature is approximately 23° C. Upon cooling slowly from a temperature higher than room temperature to 25° C.-50° C. under ambient conditions results in a clear solution for electrospinning (K-H Lee, S. Givens, D. B. Chase and J. F. Rabolt, Polymer 2006, 47, 8013 ("Lee"))

Solubility of polyolefin class polymers depends strongly on the chemical structures and molecular weight. For example, poly(methyl-1-styrene) and polystyrene(PS) solutions can be prepared at room temperature while polyethylene, polypropylene, polybutene, and poly(4-methyl-1-pentene), etc solutions can not be prepared at room temperature. These polymers require heating for preparation of clear solutions for electrospinning. Tailoring the multi-component solvent system with a blend of solvent and non-solvent for the specific polyolefin class polymers allows for a disruption of chain-chain interactions yielding a clear solution for electrospinning at room temperature in polypropylene, polybutene, and poly(4-methyl-1-pentene), etc systems.

According to the invention, the polymer component is a single polyolefin or a mixture of polyolefins, where the polyolefins also include polyolefin copolymers and/or modified polyolefins. Mixtures of different polyolefins are very interesting due to varying physical properties such as mechanical, physical and thermal characteristics. For example, by adding a certain amount of poly(4-methyl-1-pentene) in poly(1-butene), thermal characteristics can be influenced, while adding certain amounts of a polyolefin with a high molecular weight can increase mechanical properties. In this case, high molecular weight polyolefins must be soluble in the solvent used.

In general, polyolefins, poly-α-olefins, their copolymers and/or their polymer blends have good chemical resistance and require high temperature (above 100° C. except poly(α-methyl styrene)) to prepare the clear solutions. Solutions turbid at lower temperature eventually form a gel.

DETAILED DESCRIPTION OF THE INVENTION

Figure 1:
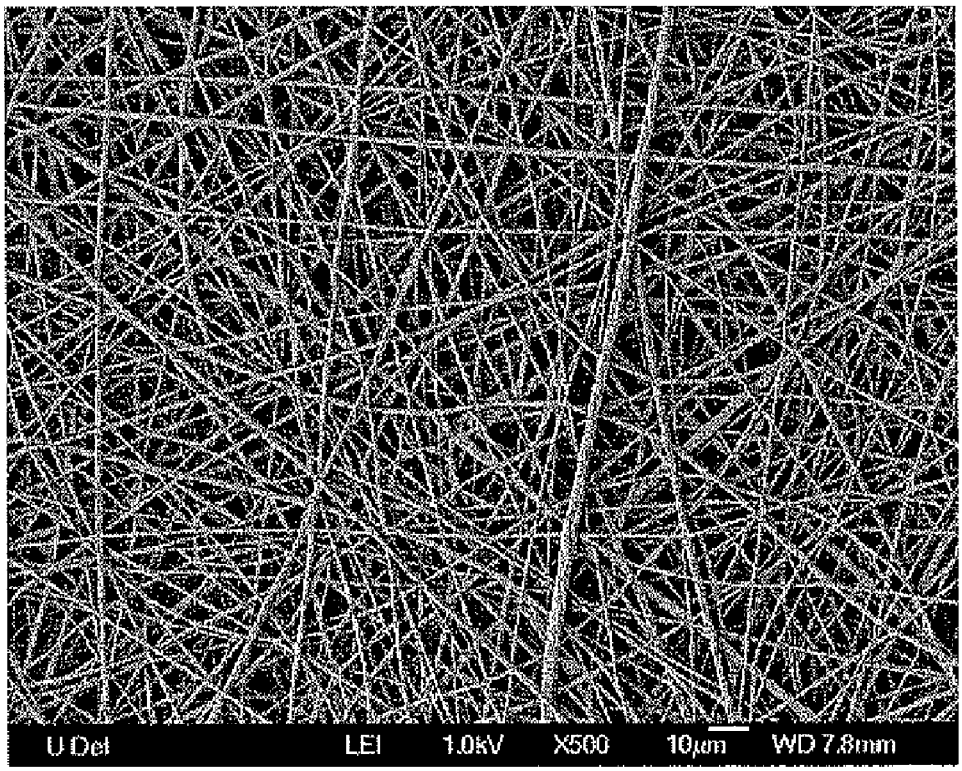
FIG. 1 shows a field-emission scanning electron microscope (FE-SEM) image of an electrospun polypropylene fiber membrane from cyclohexane, acetone and DMF (80/10/10 w/w/w/—weight %) according to example 1 at ×500 magnification.
Figure 2:
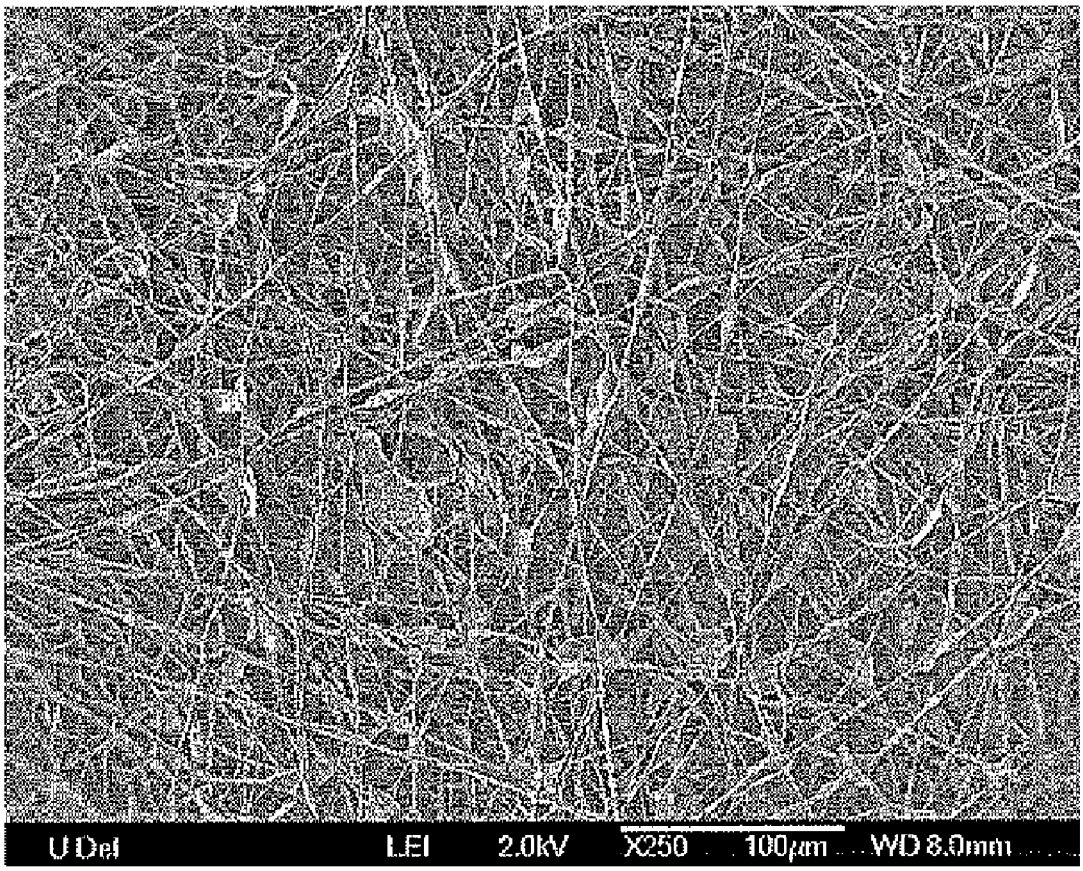
FIG. 2 shows a field-emission scanning electron microscope (FE-SEM) image of an electrospun poly(1-butene) fiber membrane from cyclohexane, acetone and DMF (80/10/10 w/w/w/—weight %) according to example 1 at ×250 magnification.
Figure 3:
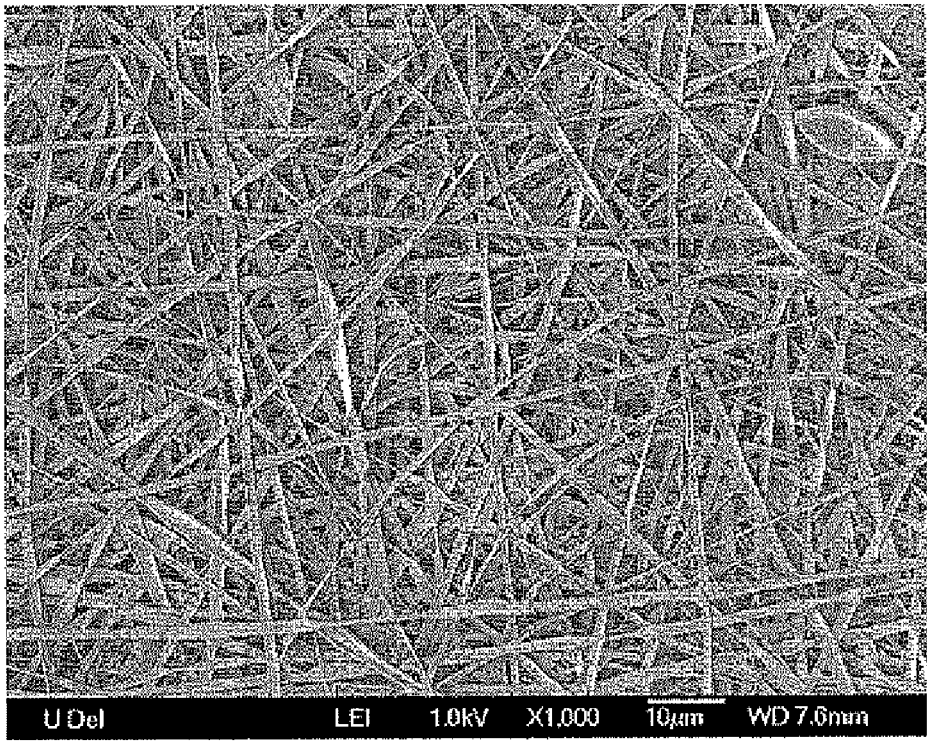
FIG. 3 shows a field-emission scanning electron microscope (FE-SEM) image of an electrospun poly(4-methyl-1-pentene) fiber membrane from cyclohexane, acetone and DMF (80/10/10 w/w/w/—weight %) according to example 1 at ×1000 magnification.

According to the invention, polyolefin polymers are completely dissolved in a multi-component solvent system to form a clear solution when heated preferably to 50° C.-100° C. depending on the solvent type, the polymer type and the molecular weight. Cooling the polymer solutions slowly under ambient conditions to 25° C.-50° C. depending on the solvent type, the polymer type and polymer concentration results in clear solutions for electrospinning. Tailoring the multi-component solvent system with a blend of solvent and non-solvent for the specific polyolefin class polymer allows for a disruption of chain-chain interactions yielding a clear solution for electrospinning at room temperature in polypropylene, polybutene, and poly(4-methyl-1-pentene), etc. systems. This is a novel result never before obtained. All other work on electrospinning of polypropylene, polybutene, and poly(4-methyl-1-pentene), etc systems has been performed in melt electrospinning without the presence of solvent.

The invention has potential applications in filtration of liquids, gases and molecular filters. Reinforcement of composite materials, protective clothing, protective masks, biomedical application such as medical prostheses, tissue engineering templates, wound dressing, drug delivery systems, and pharmaceutical compositions, cosmetic skin care and cleaning etc. are additional applications.

Clear solutions, an indicator that gelation has not occurred in polyolefins, poly-α-olefins, their copolymers and/or polymer blends, can be obtained by dissolving the polymer in a good solvent and/or in a mixture of solvent and non-solvents at room temperature up to to temperatures at which the solvents boil depending on the polymer concentration, molecular weight and polymer type. When the clear solutions were lowered to room temperature (25° C.), these solutions remained clear for a certain time.

The fibers are made from a polymer solution by an electrospinning process as described in Reneker, U.S. Pat. No. 4,323,525, U.S. Pat. No. 4,689,525, US 20030195611, US 20040018226, and US 20010045547, which are incorporated herein by reference in their entirety for all useful purposes.

The polymers that are preferably used are listed in Huang, US 20030195611, US 20040037813, US 20040038014, US 20040018226, US20040013873, US 2003021792, US 20030215624, US 20030195611, U S 20030168756, US 20030106294, US 20020175449, US20020100725, US20020084178 and also in the following U.S publications, US 20020046656, US 20040187454, US 20040123572, US 20040060269, US 20040060268 and US 20030106294. All these publications are all incorporated by reference in their entireties for all useful purposes.

The preferred solvents that may be used are (a) a high-volatility solvent group, including acetone, chloroform, ethanol, isopropanol, methanol, toluene, tetrahydrofuran, water, benzene, benzyl alcohol, 1,4-dioxane, propanol, carbon tetrachloride, cyclohexane, cyclohexanone, methylene chloride, dichloromethane, phenol, pyridine, trichloroethane, acetic acid; or (b) a relatively low-volatile solvent group, including N,N-dimethyl formamide (DMF), dimethyl sulfoxide (DMSO), N,N-dimethylacetamide (DMAc), 1-methyl-2-pyrrolidone (NMP), ethylene carbonate (EC), propylene carbonate (PC), dimethyl carbonate (DMC), acetonitrile (AN), N-methylmorpholine-N-oxide, butylene carbonate (BC), 1,4-butyrolactone (BL), diethyl carbonate (DEC), diethylether (DEE), 1,2-dimethoxyethane (DME), 1,3-dimethyl-2-imidazolidinone (DMI), 1,3-dioxolane (DOL), ethyl methyl carbonate (EMC), methyl formate (MF), 3-methyloxazolidin-2-one (MO), methyl propionate (MP), 2-methyltetrahydrofuran (MeTHF) or sulpholane (SL). Other solvents that can be used are listed in US20020100725 and US20030195611, which are incorporated by reference. The amount of polymer and solvent will vary from 0.1-99.9%, the latter being a highly concentrated polymer solution. In general, it has been shown that polymers can be electrospun when their concentration in solution, C, multiplied by the intrinsic viscosity of the solution, η, is ≧8.9 (M. G. McKee, G. L. Wilkes R. L. Colby and T. E. Long, Macromolecules 2004, 37, 1760 ("McKee").

The concentration of polymer and solvent can be the same as discussed in the electrospinning publications and patents, Reneker, Megelski, Casper, U.S. Pat. No. 4,323,525, U.S. Pat. No. 4,689,525, US 20030195611, US 20040018226 and US 20010045547, which are all incorporated herein by reference in their entirety for all useful purposes.

Electrospinning or electrostatic spinning is a process for creating fine polymer fibers using an electrically charged solution that is driven from a source to a target with an electrical field. Using an electric field to draw the positively charged solution results in a jet of solution from the orifice of the source container to the grounded target. The jet forms a cone shape, called a Taylor cone, as it travels from the orifice. Typically, as the distance from the orifice increases, the cone becomes stretched until, near the target, the jet splits or splays into many fibers prior to reaching the target. Also prior to reaching the target, and depending on many variables, including target distance, charge, solution viscosity, temperature, solvent volatility, polymer flow rate, and others, the fibers begin to dry. These fibers are extremely thin, typically measured in nanometers. The collection of these fibers on the target, assuming the solution is controlled to ensure the fibers are still wet enough to adhere to each other when reaching the target, form a randomly oriented fibrous material with extremely high porosity and surface area, and a very small average pore size.

The basic components required for solvent electrospinning are as follows A polymer is mixed with a solvent to form a solution having desired qualities. The solution is loaded into a syringe like container that is fluidly connected to a blunt needle to form a spinneret. The needle has a distal opening through which the solution is ejected by a controlled force, represented here in a simplified manner as being supplied by a plunger but can be any appropriate controllable variable rate fluid displacement system and should be automated to ensure accurate flow rates.

The electrospinning process is carried out at temperatures ranging from a lower limit at which the solvent freezes to an upper limit where the solvent evaporates or the polymer degrades chemically.

EXAMPLES

Example 1

As a result of electrospinning the polyolefin solutions, fibers whose diameters range between 1 and 10 microns are produced depending on the concentration of polyolefin in the mixed solvent system. Under other conditions, fibers smaller and bigger than this range have been produced by the electrospinning process as described in Megelski, "Stephens" (J. S. Stephens, J. F. Rabolt, S. Fahnestock and D. B. Chase, MRS Proceedings 774, 31(2003)), US20030195611 and US20030168756 which are incorporated by reference.

The as-produced fibers have been studied using both optical and field emission scanning electron microscopy (FE-SEM) in order to ascertain any surface topography that may exist and to determine the presence of any morphological defects.

Example 2

Poly(4-methyl-1-pentene) (PMP) is a widely used polymer in industry and specifically, in medical products. Producing micro- or nanofiber membranes would expand the usefulness of PMP to a broaden range of medical applications. A choice of solvent quality for the solution used for electrospinning can have a dramatic effect on the spinnability of fibers and on their morphological appearance. We tested the following four solvent systems: cyclohexane, cyclohexane/acetone mixture, cyclohexane/dimethyl formamide (DMF) mixture and cyclohexane/acetone/DMF mixture. As demonstrated by FE-SEM, electrospun fibers with different morphologies including round, twisted with a roughened texture, curled and twisted-ribbon shapes were formed. The fiber shape and morphology depended strongly on the type and amount of non-solvent used.

Each PMP solution was poured into a 3-ml syringe equipped with a 21 gauge needle (Hamilton). A high-voltage power supply (Gassman High Voltage) capable of generating voltages up to 30 kV was used to generate a 10-15 kV potential difference between the needle and a grounded metallic plate with Al-foil placed 15 cm from the tip of the needle. All fiber spinning was carried out at ambient conditions. A schematic of the electrospinning apparatus is shown in the FIG. 5.

Figure 4:
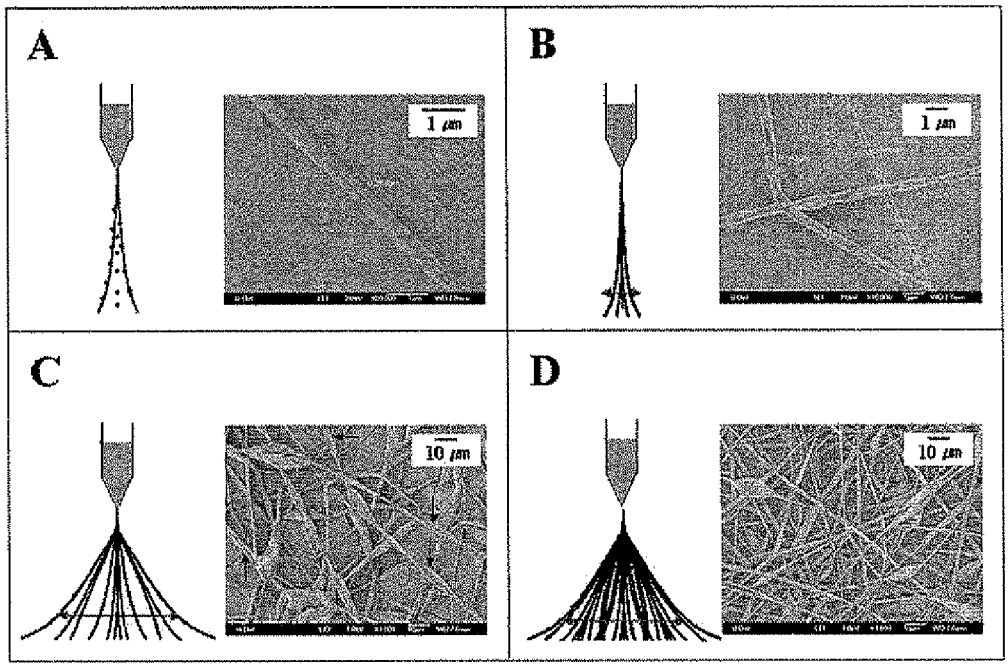
FIG. 4 contains the schematic diagram of electrospinning results and FE-SEM images of as-spun PMP fibers from solutions of PMP in (A) cyclohexane, (B) a mixture of cyclohexane and acetone (80/20, w/w—weight percent)), (C) a mixture of cyclohexane and DMF (80/20, w/w—weight %) and (D)) a mixture of cyclohexane, acetone and DMF (80/10/10, w/w/w—weight %). The arrows in FIG. 4C illustrated curled and/or twisted fibers structures.

The morphologies of electrospun PMP fiber membranes were investigated using field emission scanning electron microscopy (FE-SEM, JSM-7400F, JEOL). Typical imaging conditions were 1-2 kV and 10 μA. Depending on the mixture of solvents and nonsolvents or poor solvents used a distinctly different fiber morphology as shown in FIG. 4 was obtained.

Example 3

Figure 5:
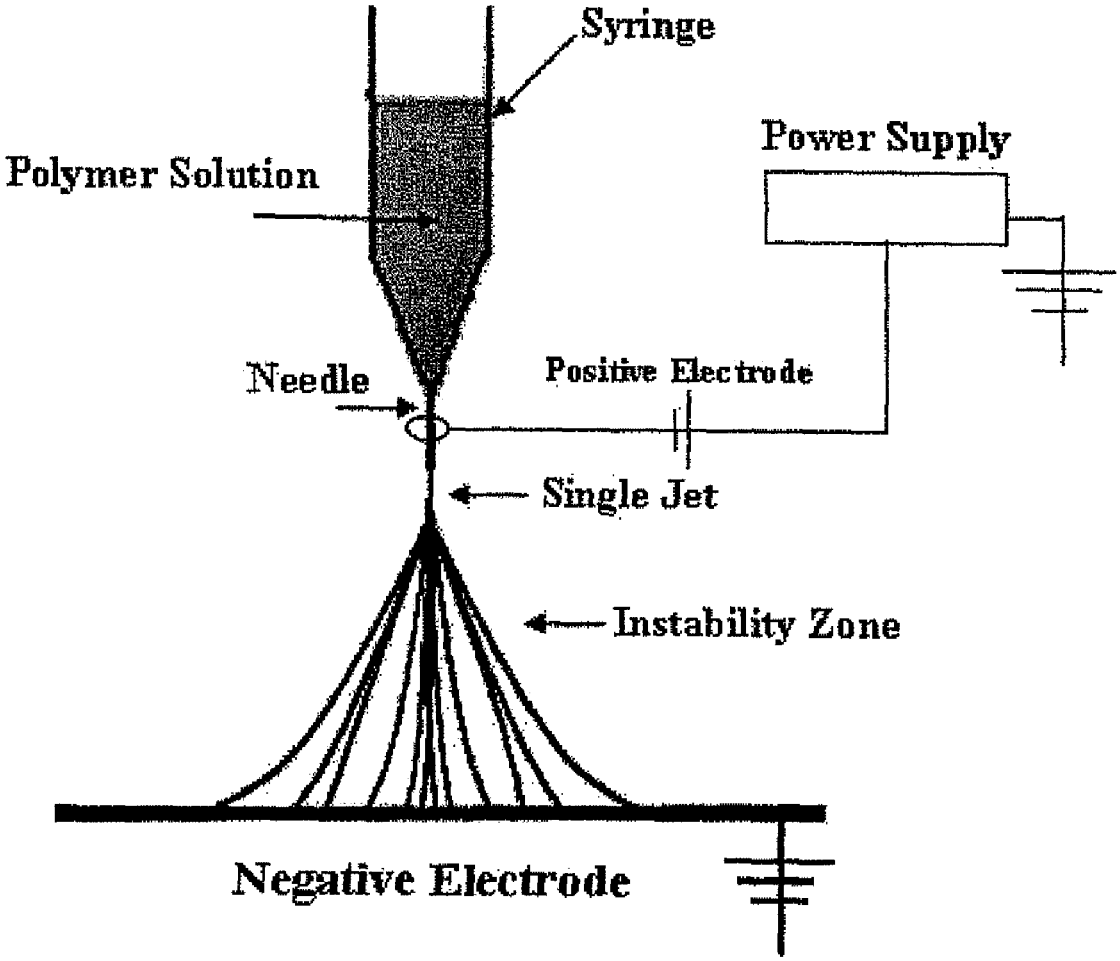
FIG. 5 is a schematic of an electrospinning process with continuous supplying system.

If a blend of two or more polyolefins is dissolved in the mixed solvent system described above then blended polymer fibers can be electrospun using the typical conditions mentioned previously. For example, PB/PMP blended fibrous mats can be produced in this way. FIG. 5 shows field-emission scanning electron microscope (FE-SEM) images of an electrospun fiber membrane of blends (PB/PMP) from cyclohexane, acetone and DMF (80/10/10 w/w/w/—weight %) according to Example 1 at ×500 magnification, (A) PB/PMP (75/25), (B) PB/PMP (50/50) and PB/PMP (25/75). In all cases, twisted flat fibers are produced.

All the references described above are incorporated by reference in its entirety for all useful purposes.

While there is shown and described certain specific structures embodying the invention, it will be manifest to those skilled in the art that various modifications and rearrangements of the parts may be made without departing from the spirit and scope of the underlying inventive concept and that the same is not limited to the particular forms herein shown and described.

We claim:

1. A process to make a polyolefin fiber which comprises mixing a) poly(4-methyl-1-pentene) or b) polybutylene and poly(4-methyl-1-pentene)

with a solvent system comprising cyclohexane and one or both of acetone and dimethyl formamide at a temperature higher than room temperature to form a polymer solution, cooling the polymer solution to room temperature, and electrospinning said polymer solution at room temperature to form a fiber.

2. The process as claimed in claim 1, wherein the temperature higher than room temperature is from above 25 to 100° C.

3. The process as claimed in claim 1, wherein the temperature higher than room temperature is from 50 to 100° C.

4. The process as claimed in claim 1, wherein the solvent system comprises cyclohexane and acetone.

5. The process as claimed in claim 1, wherein the solvent system comprises cyclohexane and dimethyl formamide.

6. The process as claimed in claim 1, wherein the solvent system comprises cyclohexane, acetone and dimethyl formamide.

7. The process as claimed in claim 1 comprising mixing both of said polybutylene and poly(4-methyl-1-pentene) with the solvent system, said polybutylene and poly(4-methyl-1-pentene) being in a ratio of 75/25-25/75 w/w.

* * * * *